US008356767B2

(12) United States Patent
Formon et al.

(10) Patent No.: US 8,356,767 B2
(45) Date of Patent: Jan. 22, 2013

(54) DISPENSER FOR MULTIPLE ROLLS OF WEB MATERIAL WITH AUTOMATIC ROLL TRANSFER, AND METHOD OF LOADING SAME

(75) Inventors: John Formon, Oxford, PA (US); Jeffrey Brickl, Lodi, WI (US); Russell Wieser, Downingtown, PA (US)

(73) Assignee: SCA Tissue North America LLC, Philadelphia, PA (US)

( * ) Notice: Subject to any disclaimer, the term of this patent is extended or adjusted under 35 U.S.C. 154(b) by 478 days.

(21) Appl. No.: 12/638,589

(22) Filed: Dec. 15, 2009

(65) Prior Publication Data

US 2011/0139920 A1 Jun. 16, 2011

(51) Int. Cl.
*B65H 19/00* (2006.01)

(52) U.S. Cl. ..... 242/559.2

(58) Field of Classification Search ..... 242/559, 242/559.1, 559.2, 559.3, 560, 560.2, 594, 242/597.5; 312/34.19, 34.22, 34.8
See application file for complete search history.

(56) References Cited

U.S. PATENT DOCUMENTS

| | | | | |
|---|---|---|---|---|
| 1,716,812 | A * | 6/1929 | Ball | 242/559.2 |
| 3,294,329 | A * | 12/1966 | Tucker et al. | 242/560.3 |
| 4,108,513 | A * | 8/1978 | Lander | 225/34 |
| 5,310,129 | A | 5/1994 | Whittington et al. | |
| 6,491,251 | B1 | 12/2002 | Stanland et al. | |
| 6,648,267 | B2 * | 11/2003 | Stanland et al. | 242/559.2 |
| 7,041,140 | B2 | 5/2006 | Picha | |
| 7,114,676 | B2 * | 10/2006 | Elliott et al. | 242/559.2 |
| 7,461,810 | B2 | 12/2008 | Goeking et al. | |
| 2006/0108467 | A1 * | 5/2006 | Elliott et al. | 242/559.2 |

FOREIGN PATENT DOCUMENTS

| | | |
|---|---|---|
| GB | 1583499 | 1/1981 |
| GB | 2245882 A | 1/1992 |
| NL | 7709378 A | 5/1978 |

OTHER PUBLICATIONS

International Search Report, dated Mar. 3, 2011, PCT/US2010/055938.

* cited by examiner

*Primary Examiner* — William A Rivera
(74) *Attorney, Agent, or Firm* — Young & Thompson

(57) ABSTRACT

A dispenser for sequentially dispensing web material from a plurality of rolls includes a carousel rotatably mounted in a dispenser body. The carousel includes a plurality of roll holders that extend parallel to an axis of rotation of the carousel. The carousel includes a sensor that senses whether a roll of web material on one of roll holders is depleted or substantially depleted. A movable trigger latch blocks rotation of the carousel until the roll of web material on the current roll holder is depleted or substantially depleted; at that point, the carousel rotates by gravity in a first direction.

20 Claims, 7 Drawing Sheets

DISPENSER FOR MULTIPLE ROLLS OF WEB MATERIAL WITH AUTOMATIC ROLL TRANSFER, AND METHOD OF LOADING SAME

BACKGROUND OF THE INVENTION

1. Field of the Invention

The present invention relates to a dispenser for web material in rolled form, and a method of loading such a dispenser. A plurality of rolls of web material are mounted on a carousel and once a current roll is spent or substantially spent, the carousel rotates to automatically transfer a next roll into a dispensing position.

2. Description of Related Art

Efforts have been made over the years to store and then sequentially dispense multiple rolls of web material. Such web material is usually in the form of paper towels or toilet tissue. However, the prior art devices are often complex and/or produce core waste, that is spent cores are not retained by the dispenser.

U.S. Pat. No. 7,461,810 describes a multiple roll dispenser in which each roll holder has an associated release arm for securing the roll in dispensing position and for permitting rotation of the roll-carrying carousel when the current roll has been depleted. In order for the carousel of this patent to rotate under the influence of gravity, the rolls must be dispensed from a position offset from the central vertical axis of the housing.

U.S. Pat. No. 5,310,129 also describes a multiple roll dispenser in which each roll holder has an associated lock mechanism and the roll being dispensed must be offset from the central vertical axis of the housing in order for the carousel to rotate under the influence of gravity when a roll being dispensed has been depleted.

U.S. Pat. Nos. 6,491,251 and 7,041,140 describe multiple tissue roll dispensers in which the catch and release mechanism for the rotary turret requires the use of split core tissue rolls, i.e., rolls in which the core is in the form of two axially separated sections.

SUMMARY OF THE INVENTION

The present invention provides a multiple roll sheet material dispenser that is mechanically simple, robust and reliable in operation, as well as a novel method of loading such a dispenser. In preferred embodiments the dispenser prevents core waste and automatically transfers a new roll to the dispensing position under the influence of gravity.

According to the invention a turret is rotatably mounted to a dispenser body. The turret includes a plurality of roll holders connected thereto. The roll holders preferably extend parallel to an axis of rotation of the turret. A catch and release mechanism is positioned at a selected position within the rotation path of the turret, and cooperates with a sensor that senses the diameter of the roll being dispensed, such that when the roll reaches a predetermined minimum diameter corresponding to a fully or almost fully depleted state, the catch and release mechanism release the downstream spindle that it had been holding and permits the turret to rotate under the influence of gravity until it catches the just-depleted spindle, whereupon the next roll of web material is in the dispensing position.

BRIEF DESCRIPTION OF THE DRAWINGS

The above and other features, advantages and objects of the present invention will be more fully apparent with reference to the following description of certain preferred embodiments of the invention, taken with reference to the accompanying drawings in which.

DETAILED DESCRIPTION OF PREFERRED EMBODIMENTS

Figure 1:
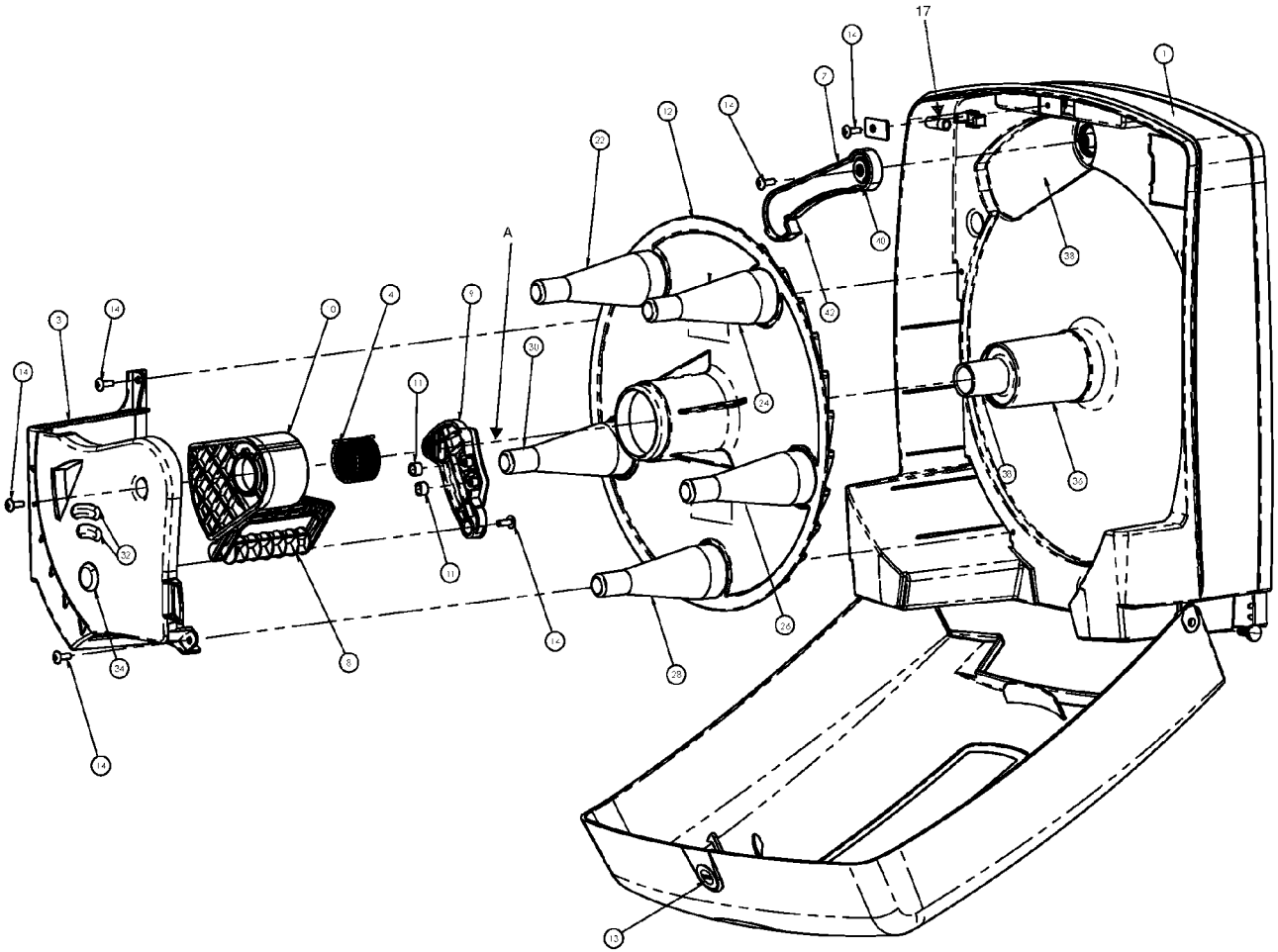
FIG. 1 is an exploded perspective view of a dispenser according to an embodiment of the present invention.

The dispenser of FIG. 1 includes a body 1 that is configured to be mounted to a vertical support structure such as a restroom wall or the wall of a toilet stall. The dispenser also includes a turret in the form of a carousel 12 rotatably mounted to a wider section 36 of a boss formed on or connected to the body 1. The turret could alternatively take the form of a spider in which the roll holders are connected not to a plate but each to a corresponding spoke radiating from a common hub.

A plurality of roll holders 22, 24, 26, 28 and 30 are connected to a front face of the carousel 12 and extend preferably in parallel to an axis of rotation A of the carousel 12. In the embodiment of FIG. 1 there are five roll holders. In practice, the number of roll holders can vary from a minimum of three to a maximum of any desired number.

The roll holders 22, 24, 26, 28 and 30 are each configured to hold a roll of web material. Such web material might be paper towels or toilet tissue or any other web material that comes in roll form. For convenience, the term tissue is used below.

In FIG. 1, the dispenser is shown with its cover in an open position. The cover is connected to the body 1 by the depicted pivot structure and is movable from the open position to a closed position covering the carousel 12 and roll holders and defining a dispensing opening. In the open position, the roll holders are accessible for loading full rolls R or replacing spent rolls or cores C.

The dispenser further includes a sensor 10 pivotally mounted to the narrower section 38 of the boss formed on or connected to the body 1. A coil spring 4 is captive between the sensor 10 and boss section 38, and urges the sensor to pivot in the counterclockwise direction. The sensor 10 includes a portion 8 that bears on the outer periphery of a roll of tissue currently being dispensed, as will be described in greater detail later. The portion 8 may be integrally formed with the remainder of sensor 10, or may take the form of a roller that is rotatably mounted within the pair of depicted arms projecting from sensor 10.

The sensor 10 is covered by a shroud 3 that is preferably formed of transparent plastic so as to permit inspection of the catch and release mechanism. Shroud 3 is fixed via screws 14 to the body 1, at points radially outside the path of carousel 12. Shroud 3 also provides an opening for receiving the screw 14 that secures the sensor 10 the narrower boss section 38. The shroud projects axially from the inside rear surface of body 1 a distance sufficient to permit the roll holders 22, 24, 26, 28 and 30 to pass by, subject to the action of the catch and release mechanism as will be described.

Sensor 10 also coacts with a trigger latch 9, which is pivotally mounted to shroud 3 at mounting point 34, via another screw 14. Trigger latch 9 includes a pair of rollers 11 to reduce the frictional contact with sensor 10. Shroud 3 includes a pair of interior arcuate grooves (visible in FIG. 1 as a pair of exterior arcuate lands 32) which receive the outer ends of rollers 11 and thus limit the range of angular movement of the trigger latch 9.

Carousel 12 rotates clockwise when transferring a fresh roll of tissue to the dispensing station, whereas pawl 7 pivotally mounted at its one end 40 in corresponding recess 38 formed in body 1 prevents rotation of carousel 12 in the counterclockwise direction, by its other end 42 engaging with the series of inclined ramps formed on the opposite side of carousel 12, in the manner of a conventional ratchet mechanism.

The cover of the dispenser includes a latch mechanism 13, preferably operated by a key, that keeps the cover in the closed position.

It will be noted that the roll holders 22, 24, 26, 28 and 30 of this embodiment are wider at their ends proximate the turntable 12 and taper toward narrower portions at the opposite, free distal ends. As such, these roll holders are adapted to holds rolls of tissue as described in the commonly owned copending application Ser. No. 11/541,666, the entirety of which is hereby expressly incorporated by reference.

Figure 2:
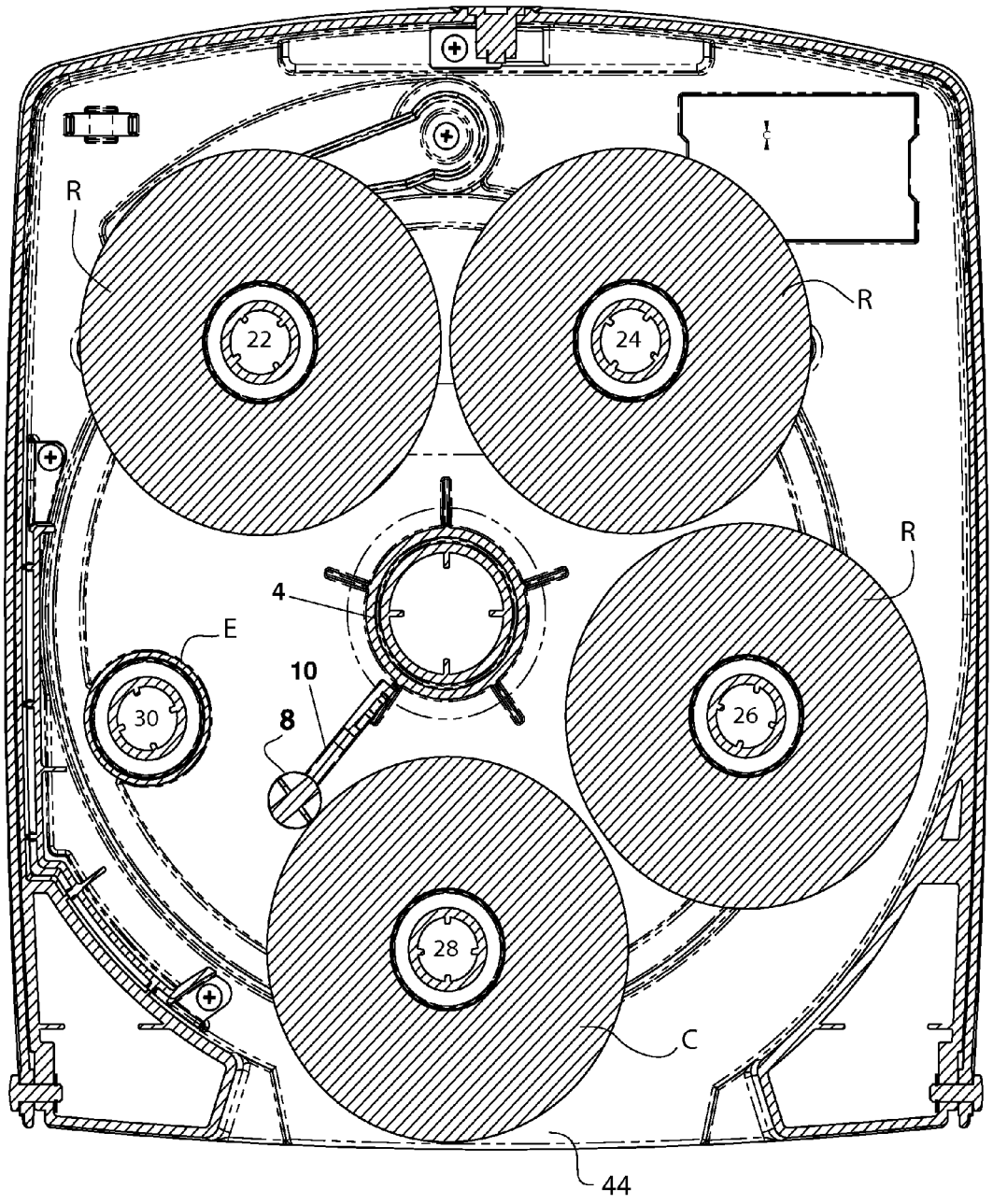
FIG. 2 is a vertical sectional view showing the roll diameter sensor of the FIG. 1 dispenser on a full roll of web material.
Figure 5:
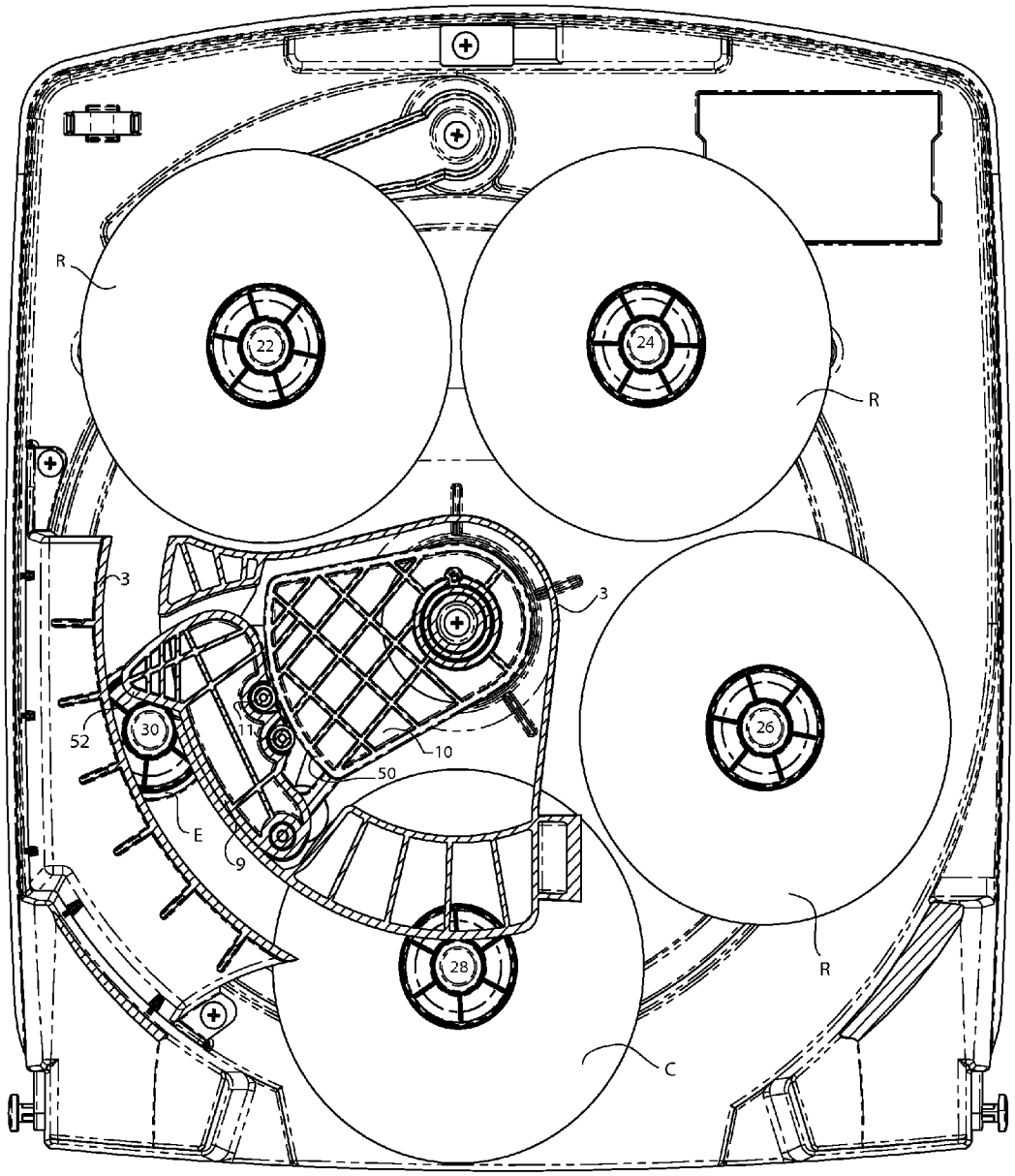
FIG. 5 is a vertical sectional view on a plane closer to the front of the dispenser, with the cover removed, in the state corresponding to FIG. 2.

In FIG. 2, the dispenser contains four full rolls of tissue, a roll C in the dispensing position on roll holder 28 and three rolls R in reserve on holders 22, 24 and 26. Roll holder 30 is either empty or holds a fully or almost fully depleted roll core from a previous dispensing cycle. Roll holder 30 is latched in this position by trigger latch 9, as shown in FIG. 5.

A notable feature of this embodiment is that the latch is positioned within the southwest quadrant of the turret, so as to latch a roll holder that has just advanced from the dispensing position, and is therefore either empty or holds a spent or nearly spent roll. Obviously, if the turret were configured for counterclockwise rotation, the latch would be in the southeast quadrant, and the dispenser would be essentially a mirror image of that shown. In this embodiment, only four rolls of tissue are loaded into the dispenser despite the presence of five roll holders, so that the roll holder in the position of holder 30 in FIG. 2 will always be either empty or holding a spent or nearly spent roll. This provides an imbalance in the center of gravity of the turret that causes the turret to rotate automatically in the clockwise direction under the influence of gravity, when the roll C becomes depleted as described herein. Preferably, in order to optimize the effects of gravity, the dispenser includes a means for ensuring that the unit is level, such as a bubble level 17 as seen in FIG. 1.

By virtue of this construction and technique, the roll C currently being dispensed may be suspended on the vertical axis of the dispenser, which is to say that axis of rotation of the roll holder 28 is aligned vertically with the axis of rotation of turret 12, i.e., the roll being dispensed in this embodiment may be in the "six o'clock" position, in contrast to the prior art discussed above.

The ability to have the current roll in the six o'clock position means that it will be positioned directly above the dispensing opening 44 of the dispenser, which in turn will minimize the force need to pull a length of tissue from the roll C, and prevent the withdrawn web from tearing prematurely.

In FIG. 2, the roller 8 of sensor 10 bears against the outer generally cylindrical periphery of the current roll C, which at this point is still nearly full. As the roll C is depleted, spring 4 urges sensor 10 to pivot counterclockwise, such that roller 8 remains in contact with the cylindrical periphery of roll C as it continues to be depleted.

Figure 3:
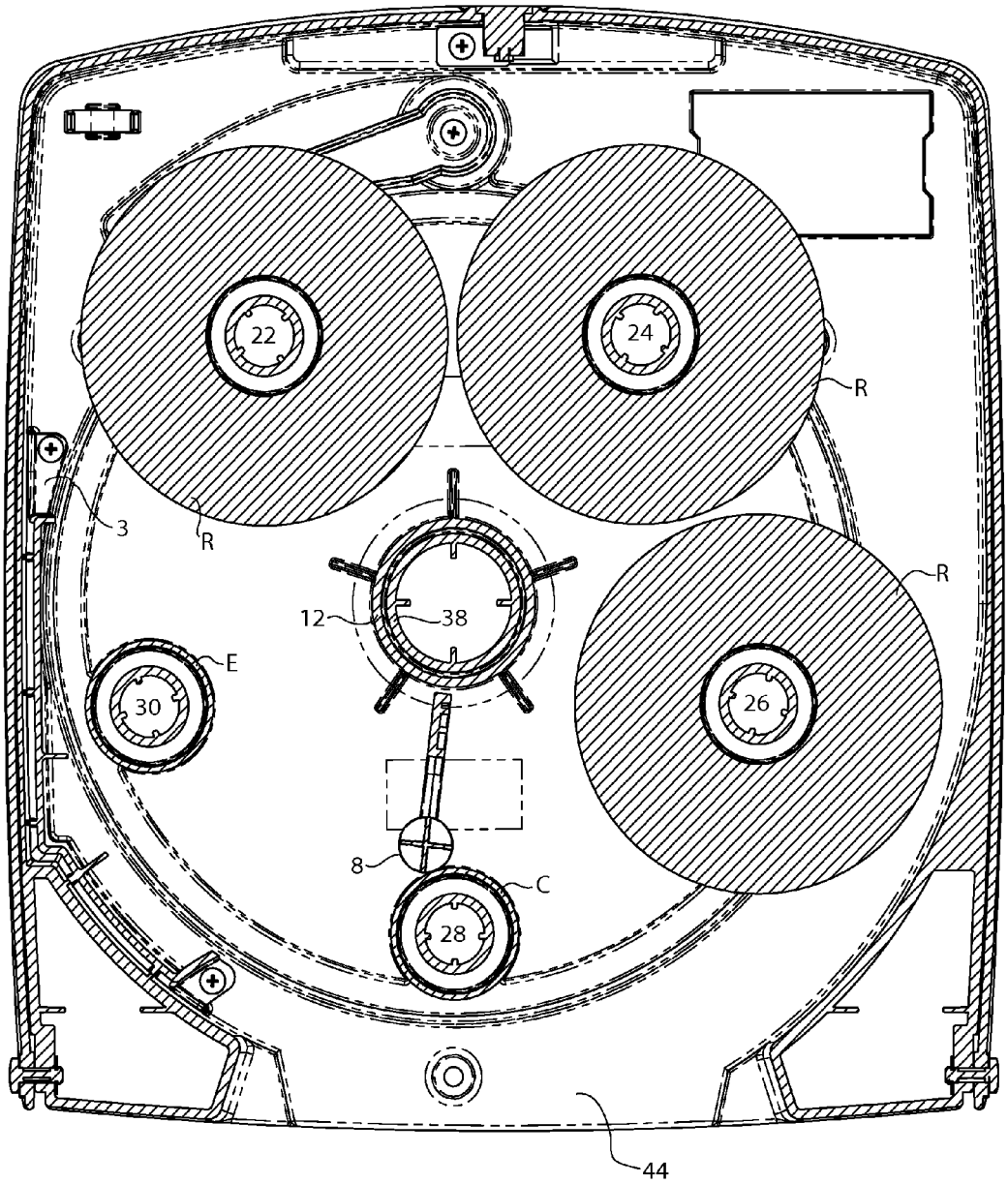
FIG. 3 is a view similar to FIG. 2 when the roll has become depleted and just prior to release of the latch mechanism.

FIG. 3 shows the condition in which the roll C has been fully or nearly fully depleted, i.e., just before the catch mechanism will release roll holder 30 and permit clockwise rotation of the carousel 12 so as to bring roll holder 26 into dispensing position. Roller 8 is maintained in contact with the roll C by the action of spring 4.

Figure 4:
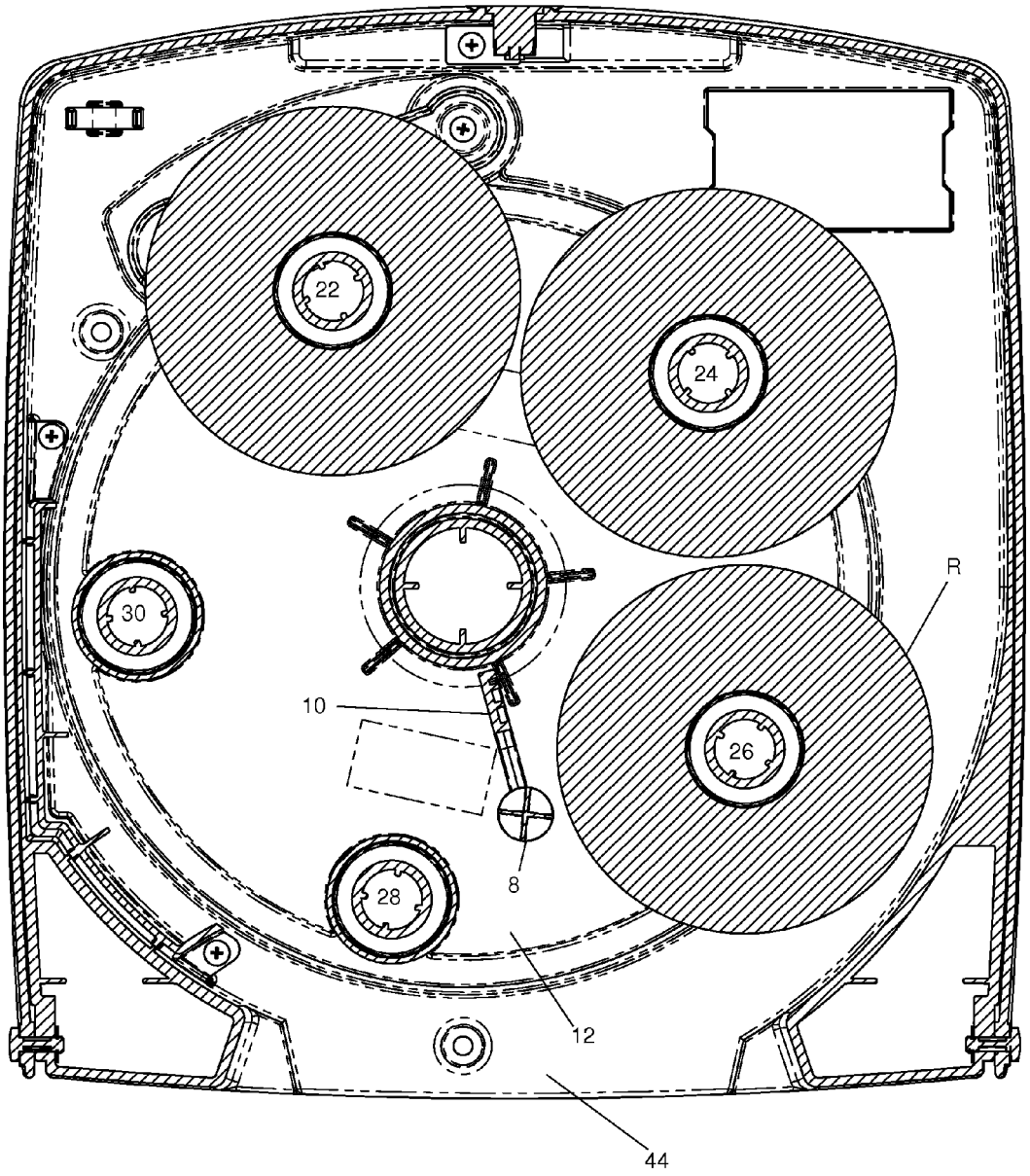
FIG. 4 is a view similar to FIG. 3 when the latch mechanism has released the downstream spindle and the turret has begun to rotate so as to advance the next roll to the dispensing position.

In FIG. 4, the trigger latch 9 has released roll holder 30, such that turret 12 is free to rotate and as shown in this figure in fact has begun to rotate. Holder 28 is being transferred to the next position, where it will be latched by trigger latch 9, while reserve roll R on roll holder 26 is advancing toward the dispensing position above opening 44, where it will become the new current roll C. This advancing motion of turret 12 occurs automatically under the influence of gravity, as a result of the eccentric load maintained by the empty or essentially empty roll holder between the six o'clock and nine o'clock positions, which is latched by the trigger latch 9.

Figure 6:
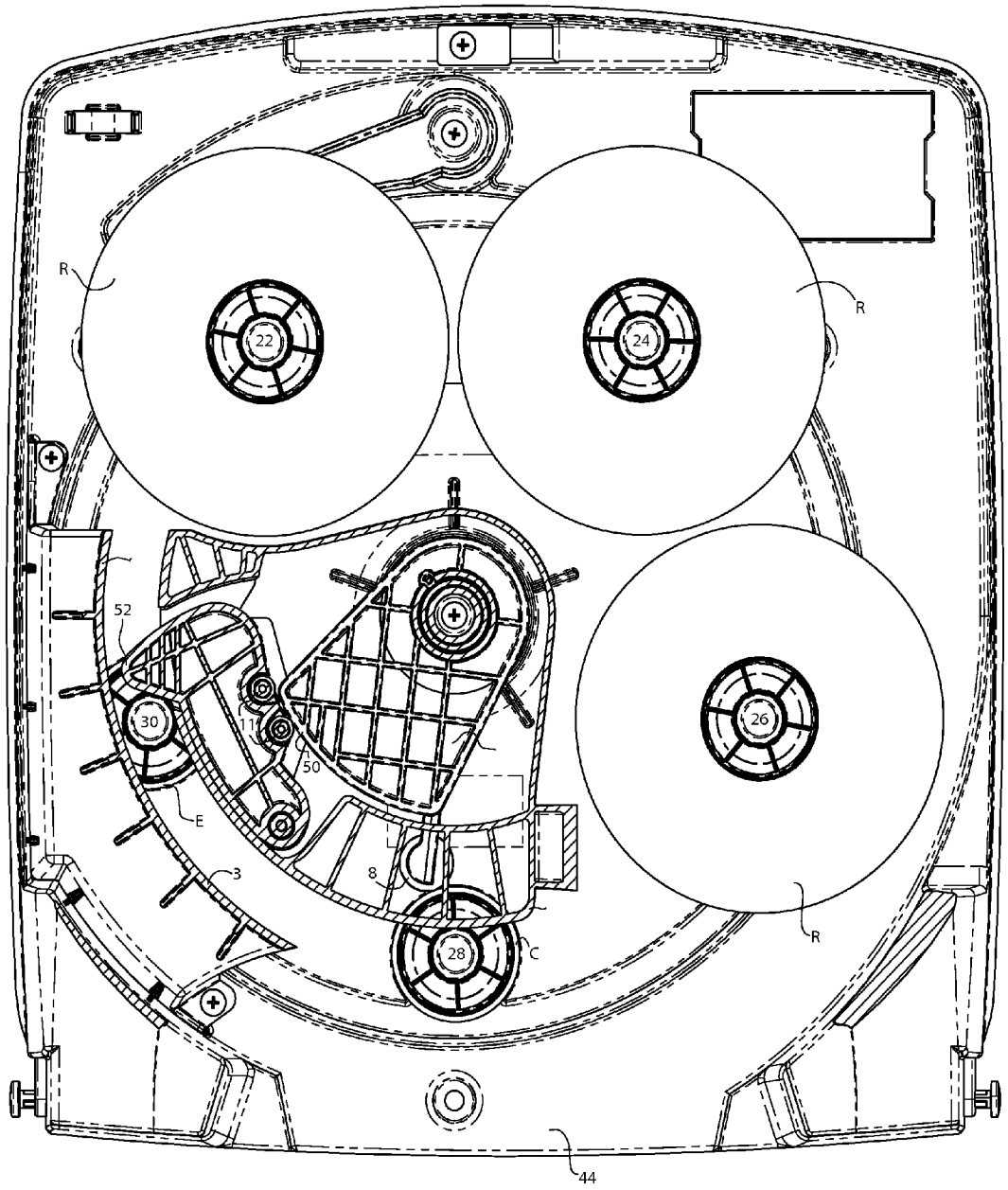
FIG. 6 is a vertical sectional view on a plane closer to the front of the dispenser, with the cover removed, in the state corresponding to FIG. 3.
Figure 7:
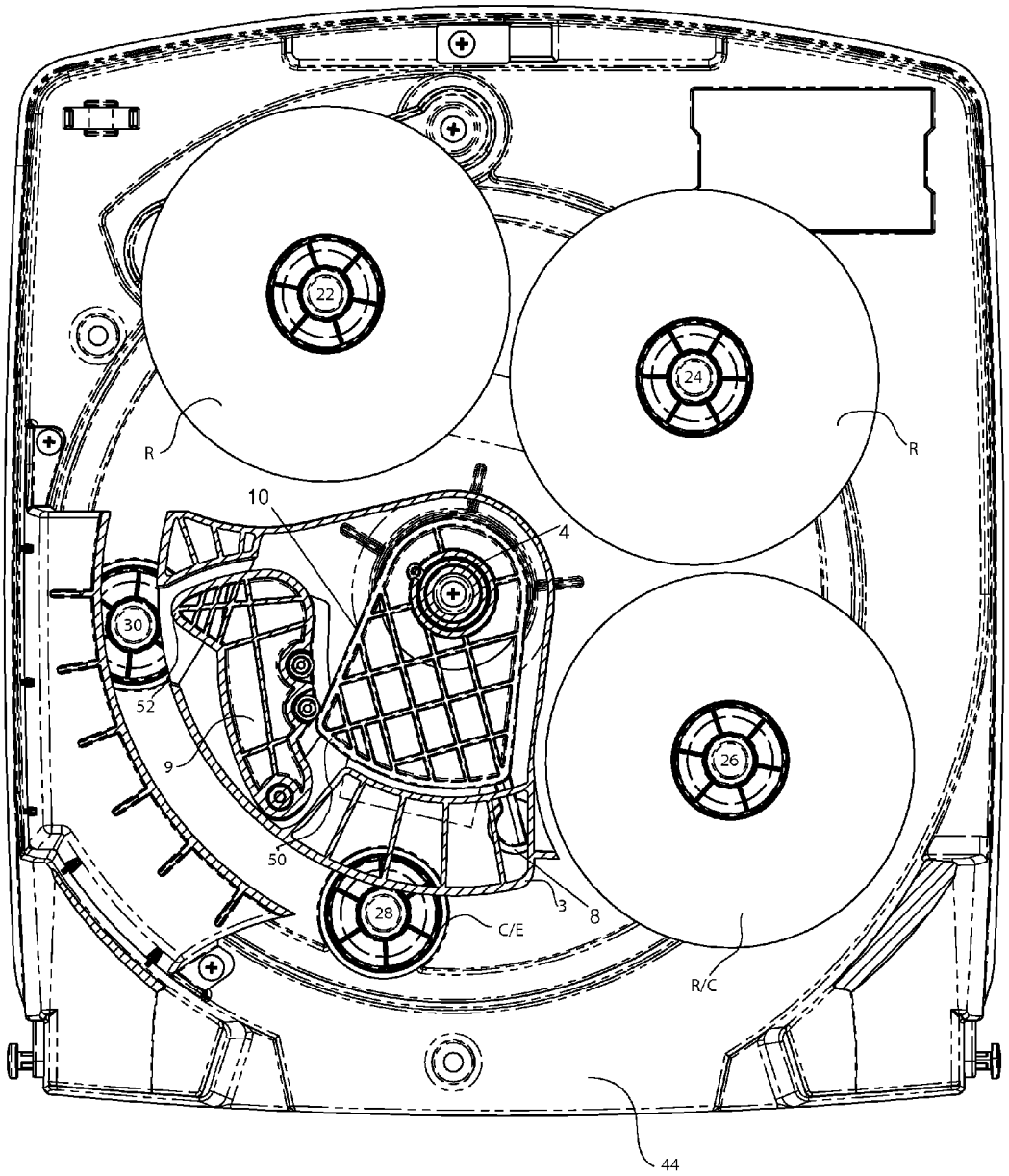
FIG. 7 is a vertical sectional view on a plane closer to the front of the dispenser, with the cover removed, in the state corresponding to FIG. 4.

FIGS. 5-7 show the relationship between sensor 10 and trigger latch 9 at the states shown in FIGS. 2-4, respectively. In FIG. 5, when the current roll C is full, the sensor 10 bears via its arcuate periphery 50 on the rollers 11 mounted on trigger latch 9, thereby keeping the hooked nose 52 of trigger latch confined on the roll holder 30. The distal end of roll holder 30 projects far enough beyond the core of the spent roll E on holder 30 that the nose 52 can latch on the roll holder 30 directly.

While the roll holders 22, 24, 26, 28 and 30 have wider proximate ends and narrower distal ends in this embodiment, it is also possible for the roll holders to be of constant or stepped diameter.

So long as the arcuate periphery 50 of sensor 10 bears on the rollers 11, the hooked nose 52 of trigger latch 9 remains on roll holder 30, and the carousel 12 is prevented from rotating. It bears noting that this arrangement has the advantage of maintaining the carousel 12 in a fixed angular orientation while the roll C is being dispensed. This is in contrast to various of the prior art dispensers discussed above, in which the carousel steadily advances as the current roll is depleted. In the present embodiment, the roller 8 applies a slight resistance to pulling web material from the roll, but that resistance is not compounded as in the prior art by the rotational moment of the overall turret loaded with the reserve rolls. This also contributes to the reliable operation of the present invention.

In FIG. 6, the current roll C has been mostly depleted, but the arcuate periphery 50 of sensor 10 remains in contact with one of the rollers 11 mounted on trigger latch 9, and thus the hooked nose 52 of trigger latch 9 continues to clamp roll holder 30, and the carousel 12 remains in the same angular orientation as in FIG. 5.

In FIG. 7, the diameter of the current roll C has decreased further, corresponding to the condition in which the roll C is either completely empty or close to completely empty. The continuing pivotal motion of sensor 10 urged by spring 4 as roller 8 follows the decreasing diameter of roll C has now caused the arcuate periphery 50 of sensor 10 to come out of contact with both rollers 11. Without the sensor 10 clamping the trigger latch 9 in the locking position, the contour of the hooked nose 52 and the rotational moment of the carousel 12 bearing against it causes the trigger latch 9 to lift off of the roll holder 30, such that the carousel 12 is free to rotate under the force of gravity in a clockwise direction so as to advance the next roll R on roll holder 26 to the dispensing location, to become the new roll C.

At this stage not only the sensor 10 but also the trigger latch 9 are positioned entirely radially inwardly of the circle described by the axes of the roll holders 22, 24, 26, 28 and 30.

As the new roll on holder 26 advances to the dispensing position, its full diameter bears on roller 8 and causes sensor 10 to pivot clockwise against the force of spring 4, to return to its initial position shown in FIG. 5. Simultaneously therewith, the newly spent core on holder 28 arrives in proximity of the trigger latch 9, just as the trigger latch 9 is being pivoted counterclockwise by the returning outer periphery 50 of sensor 10. In this way, the sensor 10 acts as a cam to move the latch back into the initial position of FIG. 5.

The latching arrangement of this embodiment thus automatically resets itself as the new roll advances to the dispensing position. Furthermore, this embodiment permits using only a single catch and release mechanism that is common to all of the roll holders.

In the present embodiments the trigger latch 9 is substantially L-shaped with a first end being pivotal about the axis defined by screw 14 and mounting point 34 (see FIG. 1) and a second end 52 in contact with one of the roll holders. However, the trigger latch 9 can be any shape such as T-shaped or Y-shaped so long as it is able to latch the roll holder and block rotation of the carousel 12 when the sensor bears against it and permit rotation of the carousel 12 when the sensor does not bear against it.

To load this dispenser, the washroom attendant or other user opens the cover of the dispenser by using the appropriate key in the locking mechanism 13, and pivots the cover downwardly to the position shown in FIG. 1. At this point, there is hopefully some tissue remaining on the roll C, whereas the roll holder 30 carries a spent roll and one or more of the roll holders 22, 24 and 26 also carry spent rolls. The washroom attendant removes the cores of the spent rolls, which have been retained by their respective roll holders, and places fresh rolls on each roll holder. The roll holder 28 carrying the current roll C might or might not need a fresh roll at this stage, whereas the roll holder 30 that is currently being clamped by the trigger latch 9 does not receive a fresh roll, so that it preserves the weight imbalance of the carousel 12 that causes it to advance by gravity when the trigger latch 9 is released. Since roll holder 30 is behind the shroud 3, it cannot be accessed and thus the imbalance of the carousel is maintained for optimal operation of the dispenser.

The above description and embodiments are presented as non-limiting examples. Modifications within the scope and spirit of the invention will be readily apparent to those of ordinary skill in the art after reading the present specification.

What is claimed is:

1. A dispenser comprising:

a body;

a turret rotatably mounted in said body;

a plurality of roll holders connected to said turret and extending generally parallel to an axis of rotation of said turret;

a cover connected to said body and movable from a closed position covering said turret to an open position that permits accessing said turret;

a roll diameter sensor mounted within said dispenser fixed about said axis of rotation of said turret, one end of the sensor including a portion that is configured to bear on a roll of web material currently being dispensed, said sensor sensing whether a roll of web material on one of said plurality of roll holders has reached a predetermined minimum diameter; and a movable trigger latch mounted within said dispenser and common to each of said plurality of roll holders, said trigger latch blocking rotation of said turret until said roll of web material on said one of said plurality of roll holders has reached said predetermined minimum diameter, said trigger latch then releasing said turret to rotate in a first direction.

2. The dispenser as claimed in claim 1, wherein the sensor includes an edge movable from a first position in contact with said trigger latch to a second position free of contact with said trigger latch.

3. The dispenser as claimed in claim 2, wherein the edge is movable from the second position back to the first position so as to move the trigger by cam action to block rotation of the turret.

4. The dispenser as claimed in claim 1, wherein said trigger latch is mounted for pivotal movement about an axis that is parallel to said axis of rotation of said turret.

5. The dispenser as claimed in claim 1, wherein said trigger latch is movable from a first position in which it clamps one of said plurality of roll holders to a second position free of contact with said one of said plurality of roll holders.

6. The dispenser as claimed in claim 1, further comprising means for preventing rotation of said turret in a direction opposite said first direction.

7. The dispenser as claimed in claim 6, wherein said trigger latch clamps one of said plurality of roll holders that is adjacent in a downstream direction to said one of said plurality of roll holders carrying the roll on which the sensor contact element bears.

8. The dispenser as claimed in claim 1, wherein said portion of said sensor includes a contact element adapted to bear on a periphery of the roll of web material mounted on one of said plurality of roll holders.

9. The dispenser as claimed in claim 1, wherein said trigger latch is mounted in a sector of said dispenser that is below said axis of rotation and to one side of a vertical line passing through said axis of rotation.

10. The dispenser as claimed in claim 1, further comprising a means for leveling the dispenser.

11. The dispenser as claimed in claim 1, wherein the sensor is pivotally mounted on a narrower section of a boss formed on or connected to the body.

12. The dispenser as claimed in claim 11, wherein a spring is captive between the sensor and the narrower section of the boss.

13. The dispenser as claimed in claim 1, wherein the portion is integrally formed with the sensor, or the portion is a roller that is rotatably mounted within a pair of arms projecting from the end of the sensor.

14. A method of loading a multiple roll tissue dispenser having an interior rotatable turret carrying a plurality of roll holders, a trigger latch mounted in a sector of the dispenser that is below an axis of rotation of the turret and to one side of a vertical line passing through said axis of rotation and a roll diameter sensor mounted within said dispenser fixed about said axis of rotation of said turret, one end of the sensor including a portion that is configured to bear on a roll of web material currently being dispensed, the method comprising:

opening a cover of the dispenser;

removing any depleted cores on said plurality of roll holders other than a roll holder being latched by the trigger latch;

loading fresh rolls onto the plurality of roll holders, the number of fresh rolls being at most one fewer than the number of the plurality of roll holders; and closing the cover of the dispenser.

15. The method as claimed in claim 14, wherein each fresh roll of tissue comprises an insertion end and an outer end, the insertion end having a wider opening than the outer end, and wherein each of the plurality of roll holders has a wider base proximate the turret and a narrower free distal end.

16. The method as claimed in claim 14, further comprising ensuring that the dispenser is level prior to closing the cover of the dispenser.

17. The method as claimed in claim 14, wherein the sensor is pivotally mounted on a narrower section of a boss formed on or connected to the body.

18. The method as claimed in claim 17, wherein a spring is captive between the sensor and the narrower section of the boss.

19. The method as claimed in claim 14, wherein the portion is integrally formed with the sensor, or the portion is a roller that is rotatably mounted within a pair of arms projecting from the end of the sensor.

20. A dispenser comprising:

a body;

a turret rotatably mounted in said body;

more than two roll holders connected to said turret and extending generally parallel to an axis of rotation of said turret;

a cover connected to said body and movable from a closed position covering said turret to an open position that permits accessing said turret;

a roll diameter sensor mounted within said dispenser fixed about said axis of rotation of said turret on a narrower section of a boss formed on or connected to the body, one end of the sensor including a portion that is configured to bear on a roll of web material currently being dispensed, said sensor sensing whether a roll of web material on one of said plurality of roll holders has reached a predetermined minimum diameter; and a movable trigger latch mounted within said dispenser and common to each of said plurality of roll holders, said trigger latch blocking rotation of said turret until said roll of web material on said one of said plurality of roll holders has reached said predetermined minimum diameter, said trigger latch then releasing said turret to rotate in a first direction.

* * * * *